US006203447B1

(12) United States Patent
Dillard

(10) Patent No.: US 6,203,447 B1
(45) Date of Patent: Mar. 20, 2001

(54) BONDING APPARATUS FOR MODULAR SHAFTS

(75) Inventor: Terry W. Dillard, Olive Branch, MS (US)

(73) Assignee: True Temper Sports, Inc., Memphis, TN (US)

( * ) Notice: Subject to any disclaimer, the term of this patent is extended or adjusted under 35 U.S.C. 154(b) by 0 days.

(21) Appl. No.: 09/455,667

(22) Filed: Dec. 7, 1999

(51) Int. Cl.[7] ..... A63B 53/10

(52) U.S. Cl. ..... 473/316; 473/320; 473/564; 473/559

(58) Field of Search ..... 473/305–315, 473/316–323, 560–561, 566–567, 564, 559; 43/18.1; 280/819; 428/36.3, 36.9; 403/311

(56) References Cited

U.S. PATENT DOCUMENTS

| | | | |
|---|---|---|---|
| 1,428,015 | | 9/1922 | Dienner . |
| 1,615,232 | | 1/1927 | Pryde et al. . |
| 1,695,806 | * | 12/1928 | Heller . |
| 1,906,239 | * | 5/1933 | Reach . |
| 1,968,616 | | 7/1934 | Oldham . |
| 1,983,069 | * | 12/1934 | Cowdery . |
| 2,809,144 | | 10/1957 | Grimes . |
| 3,873,090 | | 3/1975 | Thompson . |
| 4,135,035 | | 1/1979 | Branen et al. . |
| 4,188,032 | | 2/1980 | Yanagioka . |
| 4,653,216 | | 3/1987 | Inoue . |
| 4,725,060 | | 2/1988 | Iwanaga . |
| 4,836,545 | | 6/1989 | Pompa . |
| 4,902,108 | * | 2/1990 | Byker . |
| 4,954,198 | | 9/1990 | Viellard . |
| 4,984,794 | * | 1/1991 | Pernelle . |
| 5,018,733 | * | 5/1991 | Buand . |
| 5,253,867 | | 10/1993 | Gafner . |
| 5,308,062 | | 5/1994 | Hogan . |
| 5,377,979 | * | 1/1995 | Long . |
| 5,439,219 | | 8/1995 | Vincent . |
| 5,465,959 | | 11/1995 | Cheng . |
| 5,665,010 | | 9/1997 | Mori . |
| 5,674,134 | | 10/1997 | Blankenship . |
| 5,735,752 | | 4/1998 | Antonious . |
| 5,766,090 | | 6/1998 | Orlowski . |
| 5,810,676 | | 9/1998 | Bird . |
| 5,820,483 | | 10/1998 | Preece et al. . |
| 5,859,508 | * | 1/1999 | Ge . |
| 5,904,627 | | 5/1999 | Miyaji et al. . |
| 5,924,937 | | 7/1999 | Kuo . |

FOREIGN PATENT DOCUMENTS

| | | | |
|---|---|---|---|
| 3-130139 | * | 6/1991 | (JP) . |

* cited by examiner

*Primary Examiner*—Jeanette Chapman
*Assistant Examiner*—Stephen L. Blau
(74) *Attorney, Agent, or Firm*—Harness, Dickey & Pierce, P.L.C.

(57) ABSTRACT

The present invention includes an athletic apparatus such as a golf shaft that includes a first tubular segment, a second tubular segment, and a bond apparatus to couple the first and second tubular segments. The first segment includes an inner surface defining a passage. The second segment includes a shoulder and projection extending axially from the shoulder. The projection defines a bonding surface and extends into the passage. The bond apparatus is between the bonding surface and the inner surface of the first segment. The bond apparatus includes an adhesive coupling the first tubular segment to the second tubular segment and a separation element engaging the inner surface of the first segment and the bonding surface of the second segment to maintain at least a predetermined separation distance between the inner surface and bonding surface.

30 Claims, 2 Drawing Sheets

BONDING APPARATUS FOR MODULAR SHAFTS

BACKGROUND OF THE INVENTION

1. Technical Field

The present invention relates generally to athletic equipment and, more particularly, to an adhesive bond for intercoupling segments of a modular shaft for athletic equipment.

2. Discussion

The design and performance of athletic equipment has advanced significantly over the past few decades. These advancements are attributable, at least in part, to the wide variety of materials from which such equipment is now manufactured. Oftentimes, these new materials are both lighter and stronger than the wood or steel used in the past for hockey sticks, tennis rackets, lacrosse sticks, polo mallets, golf club shafts, and the like. As a result, designers now have unparalleled opportunity to select an appropriate material for the specific design criteria that are important to such equipment.

A prime example of both the difficulties in design and the opportunities provided by new materials is the golf club shaft. The golf swing is a complex and high speed action wherein the shaft of the golf club is subjected to a variety of forces. The magnitude of these forces, their distribution along the shaft, and the desired performance characteristics of a golf shaft make shaft design a complex and difficult endeavor. A properly designed golf shaft balances a variety of parameters that impact the playability and feel of a golf club including the shaft's flexibility, strength, weight, and overall geometry. Notwithstanding the availability of new materials, it has proven difficult over the years to find materials that provide a proper balance of these and other parameters.

In order to accommodate the various design parameters of a golf shaft, some manufacturers have attempted to use different materials for different parts of the golf shaft. It was anticipated that this technique would allow designers to use the specific benefits of a particular material in the most applicable area of the shaft while using a different material in other areas. Despite the initial promise of this approach, difficulties in adequately coupling the two shaft segments have led to only limited success of multi-material or modular shafts.

When bonding shaft segments to one another it is important to create a strong and uniform bond. Various bonding techniques have been used within the art without adequate results. For example, shaft segments have been coupled to one another by wrapping resin impregnated wraps, commonly used to create composite shafts such as graphite shafts, over each segment. However, the bond strengths provided by the wraps have been inadequate and the overlap in the bond area has undesirable performance characteristics as well as being aesthetically unpleasing. Other attempts to bond shaft segments to one another, such as through the use of an adhesive (e.g. epoxy), have likewise been unsuccessful due, in part, to the difficulty in maintaining proper shaft alignment and achieving a sufficient and uniform bond about the shaft.

Another problem in the fabrication of modular shafts, present when metal shaft segments are used, is corrosion. Galvanic corrosion is particularly troublesome in steel golf shafts due to the difficulty in maintaining an adequate separation distance between the thin walled steel shaft segment and the adjoining shaft segment. The presence of moisture in the golfing environment heightens these corrosion concerns.

It should be appreciated that while a majority of the above discussion is presented with reference to golf club shafts, other athletic equipment shafts have similar design and performance difficulties.

In view of the above, it would be desirable to provide a bonding apparatus for athletic equipment handles and shafts that achieves a sufficient separation distance between adjoining shaft segments, an adequate and uniform bond about the segments, and that properly aligns the shaft segments. Such an apparatus would permit the effective use of multiple materials in a single athletic equipment shaft thereby allowing shaft designers to maximize the benefits achieved by each material.

SUMMARY OF THE INVENTION

Accordingly, an object of the invention is to provide a bonding apparatus for coupling segments of modular athletic equipment shafts.

Another object of the invention is to provide a bonding apparatus that includes an adhesive for coupling the shaft segments to one another and separation elements to align the shaft segments during bonding.

A further object of the invention is to provide separation elements dispersed within an adhesive in order to establish a separation distance between adjoining shaft segments and permit the adhesive to create a uniform bond between the segments.

A still further object of the invention is to provide an adhesive with separation elements that maintain a separation distance between adjoining shaft segments to avoid or limit corrosion.

Yet another object of the invention is to provide separation elements that axially align adjoining shaft segments to create a flush outer surface transition therebetween.

Still another object of the invention is to provide separation elements that extend both axially and radially relative to the common axis of the shaft segments to maintain a separation distance therebetween.

Another object of the invention is to provide a bonding apparatus for use with modular athletic equipment shafts wherein the bonding apparatus includes glass beads dispersed within an adhesive in order to establish a separation distance and axially align the shaft segments to create an aesthetically pleasing and uniform bond between the segments.

In accordance with the above, one embodiment of the present invention includes an athletic apparatus such as a golf shaft that includes a first tubular segment, a second tubular segment, and a bond apparatus to couple the first and second tubular segments. The first segment includes an inner surface defining a passage. The second segment includes a shoulder and projection extending axially from the shoulder. The projection defines a bonding surface and extends into the passage. The bond apparatus is between the bonding surface and the inner surface of the first segment. The bond apparatus includes an adhesive coupling the first tubular segment to the second tubular segment and a separation element engaging the inner surface of the first segment and the bonding surface of the second segment to maintain at least a predetermined separation distance between the inner surface and bonding surface.

Further areas of applicability of the present invention will become apparent from the detailed description provided hereinafter. It should be understood however the detailed description and specific examples, while indicating preferred embodiments of the invention, are intended for purposes of illustration only, since various changes and modifications within the spirit and scope of the invention will become apparent to those skilled in the art from the following detailed description.

DETAILED DESCRIPTION OF THE DRAWINGS

The present invention will become more fully understood from the detailed description and the accompanying drawings in which.

DETAILED DESCRIPTION OF THE PREFERRED EMBODIMENT

As is described in greater detail in this detailed description, the present invention relates to an apparatus for bonding shaft segments for athletic equipment. While this description describes the invention primarily with reference to the golf club shown in FIG. 1, it should be appreciated that the invention, as defined in the appended claims, is not so limited. The invention is applicable to a variety of athletic equipment including, but not necessarily limited to, hockey sticks, tennis rackets, lacrosse sticks, polo mallets, and the like.

Figure 1:
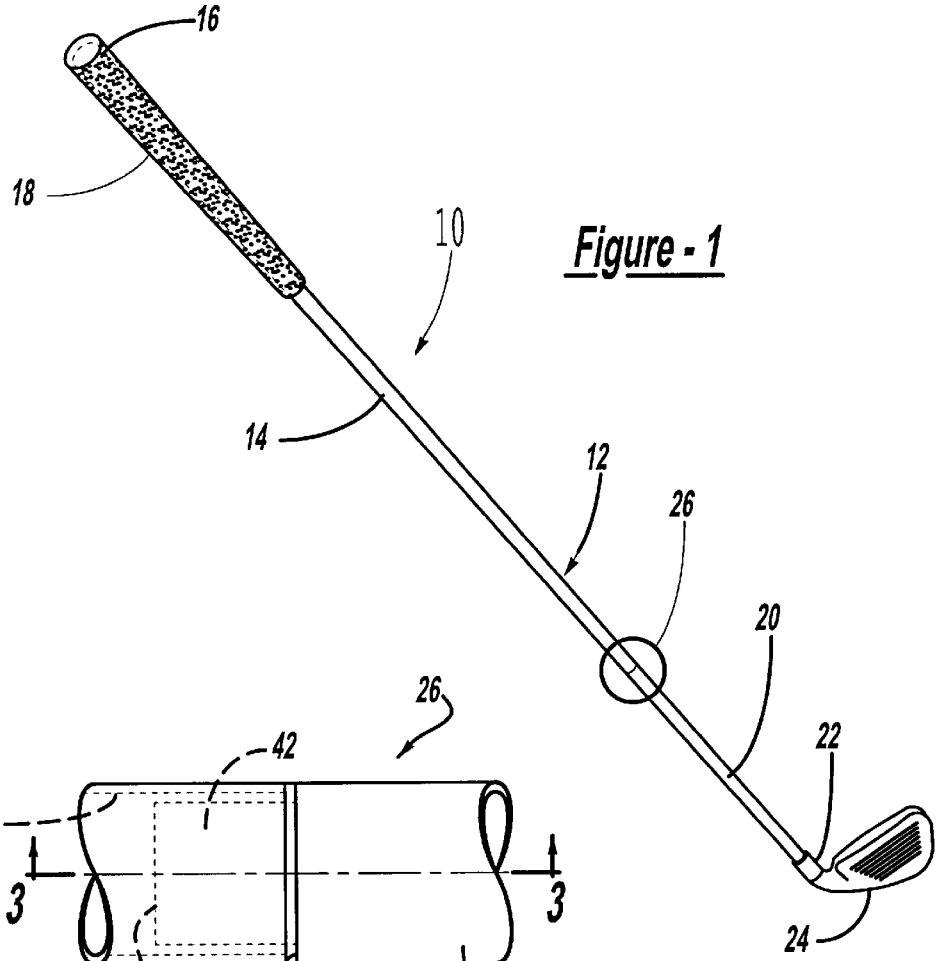
FIG. 1 is a perspective view of a golf club.

FIG. 1 illustrates a golf club 10 having a shaft 12 with a first shaft segment 14 defining a butt end 16 of the shaft 12 to which a grip 18 is coupled in a manner generally known in the art. Shaft 12 also includes a second shaft segment 20 defining a tip end 22 of the golf shaft that is coupled to a club head 24. For exemplary purposes, the club head 24 is illustrated as an iron head. However, the shaft may be used in any golf club including irons, woods, and utility clubs such as putters. The shaft 12 includes a bond area generally indicated by reference numeral 26 wherein the first and second shaft segments 14 and 20 are connected to one another. While the golf club 10 illustrated in FIG. 1 includes only a pair of shaft segments and a single bond area, those skilled in the art will appreciate from this description and the appended claims and drawings that additional shaft segments may be bonded to one another to form a shaft for athletic equipment having several shaft segments.

Figure 2:
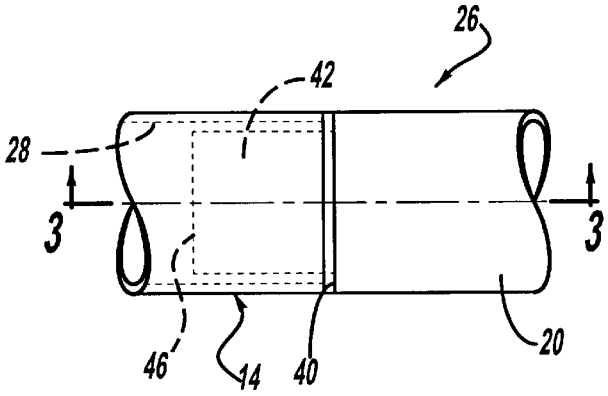
FIG. 2 is an enlarged plan view of the bond area illustrated in FIG. 1.
Figure 3:
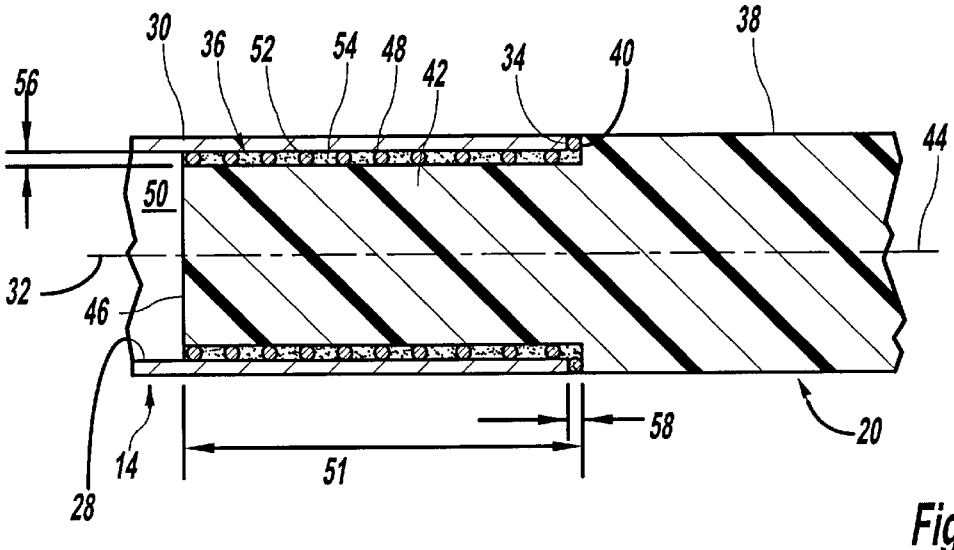
FIG. 3 is a sectional view taken along the line 3—3 in FIG. 2.

The bond area 26 is shown in greater detail in FIGS. 2–5. In FIGS. 2 and 3, a first embodiment of the golf shaft 12 is shown wherein the first shaft segment 14 is a tubular shaft segment having a generally cylindrical, tapered conical or equivalent configuration that defines an inner surface 28 and an outer surface 30, each concentric about an axis 32. First shaft segment 14 extends from a first end 34 to butt end 16 (FIG. 1) and may be formed of any material that meets the specific needs of this selected portion of the shaft. For example, it is contemplated that first shaft segment 14 may be formed of a coated steel commonly used for golf shafts and generally recognized as providing strength, durability, and consistent performance. A bond apparatus 36 couples the first shaft segment 14 to the second shaft segment 20 which is preferably formed of a different material than the first segment.

In the illustrated embodiment, second shaft segment 20 is formed of a composite such as graphite. The bond apparatus of the present invention may be used to couple first and second shaft segments formed of a variety of materials in order to optimize the performance of the athletic equipment such as the illustrated golf shaft. For example, in the manufacture of golf shafts, metals such as steel and titanium provide strength and consistency benefits while potentially negatively impacting the overall weight of the shaft. On the other hand, while composites such as graphite and metal and/or ceramic matrix composites and metal alloys may provide advantageous weight characteristics, their overall strength or other features may negatively impact the performance of the golf shaft if used throughout the shaft. The bond apparatus described and claimed herein will allow those skilled in the art to effectively couple shaft segments of different materials to one another thereby allowing designers to take advantage of the benefits of a particular material while limiting its negative effects.

In the embodiment illustrated in FIGS. 2 and 3, the second shaft segment 20 includes an outer surface 38 extending from a shoulder 40 to the tip end 22 (FIG. 1) of the second shaft segment. A projection 42 extends from shoulder 40 along axis 44 to a distal end 46 thereof. The projection is preferably cylindrical or conical in configuration to match inner surface 28 and defines a bonding surface 48 that is generally concentric about axis 44 and extends between shoulder 40 and distal end 46. Projection 42 is disposable within a passage 50 that extends inwardly from first end 34 of first shaft segment 14 and defined by inner surface 28 thereof. The distal end 46 extends from the shoulder 40 a predetermined distance to define a bond length 51 which, in the illustrated embodiment, is within the range of about one-half inch to about five (5) inches. This bond length may be varied to accommodate a particular arrangement or material selection without departing from the scope of the invention as defined by the appended claims. For example, the bond length 51 may be increased in order to provide a greater bond strength between the shaft segments or decreased to minimize the impact of the bonding of the shaft segments on the overall playability or weight of the shaft 12. More particularly, it is desirable to minimize the overlapping of the first and second shaft segments within the bond length to avoid unnecessary weight increases caused by the overlap.

The bond apparatus 36 of the present invention is configured to axially align the first and second shaft segments and to provide sufficient bonding between the bonding surface and shoulder of second shaft segment 20 and the first end 34 and inner surface 28 of first shaft segment 14. More particularly, the bond apparatus 36 of the present invention includes separation elements 52 distributed throughout an adhesive 54. The separation elements 52 are preferably glass beads having a diameter of about five-one thousandth ($^{5}/_{1000}$) of an inch and are disposed between the bonding surface 48 and inner surface 28 to maintain a transverse separation distance 56 and between the shoulder 40 and first end 34 to maintain an annular separation distance 58. The uniform transverse separation distance 56 about the bonding surface 48 aligns axis 32 of first shaft segment 14 with axis 44 of second shaft segment 20. This axial alignment of the shaft segments also insures a smooth transition between the outer surfaces 30 and 38 of the first and second shaft segments 14 and 20, respectively. It should be appreciated that the separation elements 52 may include glass beads of varying diameters as well as materials other than glass beads such as, for example, plastic beads, glass cloth, and wire. Suitable alternative separation elements will provide consistent separation between the bonding surface 48 and inner surface 28 to maintain the proper bond thickness and be dispersible within the adhesive without negatively impacting the properties of the adhesive.

In the preferred embodiment of the present invention, the adhesive is an epoxy or acrylic based adhesive. More particularly, it is contemplated that an epoxy based adhesive such as that manufactured by Minnesota Mining and Manufacturing Corporation (3M) of Minneapolis, Minn. and referred to as DP-420 or an acrylic adhesive manufactured by 3M and referred to as DP-810 are particularly applicable for the golf shaft application described herein. However, other adhesives may be used to bond the shaft segments to one another. In general, it is specifically preferred that acceptable adhesives should provide on the order of 4,500 psi shear strength and a twenty-four hour cure rate at room temperature or a quicker cure at an elevated temperature.

For ease of assembly, it is preferred that the separation elements 52 are dispersed throughout the adhesive 54 in a random manner and in sufficient quantity to insure uniform separation between the first and second shaft segments. It is specifically preferred that the volume percentage of the separation elements is in the range of about one percent (1%) to about two percent (2%) of the adhesive volume. However, other separation element quantities may be used where the amount of adhesive is sufficient to adequately bond the first and second shaft segments to one another and the separation element quantity is sufficient to maintain a uniform transverse separation distance 56 about bonding surface 48 and, if appropriate, a uniform annular separation distance 58.

As noted above, a variety of configurations for the first and second shaft segments may be used without departing from the scope of the invention as defined by the appended claims. The composition and configuration of the shaft segments may be selected to optimize the overall performance of the shaft. For example, as a general proposition the tip end of a golf shaft is subjected to greater stresses than the butt end thereof. Also, due to the tapered nature of a golf shaft, the tip end generally has a smaller outer diameter than the butt end. To accommodate the increased stresses in this reduced area, it may be desirable to form the tip end of a metallic material having relatively high strength and resistance to torque.

Figure 4:
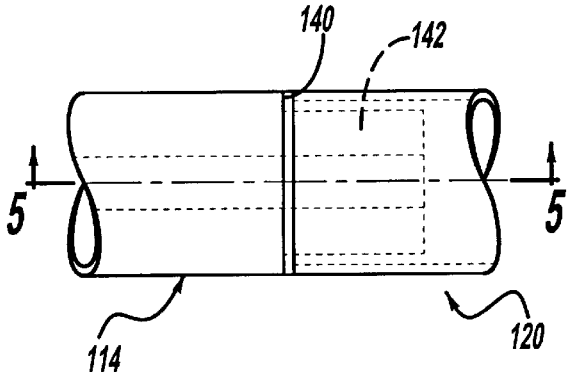
FIG. 4 is an enlarged plan view of the bond area shown in FIG. 1 for a second embodiment of the invention.
Figure 5:
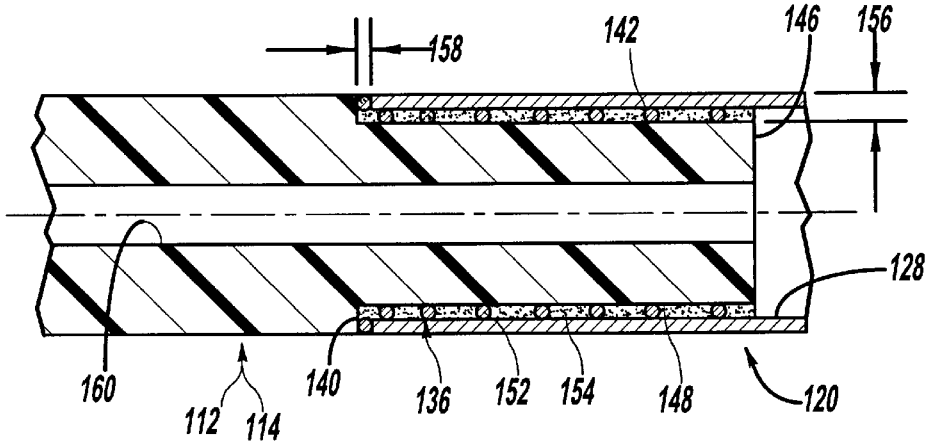
FIG. 5 is a sectional view taken along the line 5—5 in FIG. 4.

As is illustrated in FIGS. 4 and 5, first shaft segment 112 may be formed of a composite material such as graphite whereas the second shaft segment extending to tip end 22 (FIG. 1) may be formed of a tubular steel segment in order to accommodate the increased tip stresses. It is specifically contemplated that titanium as well as other high strength materials may be equally suitable for use in the tip end of the golf shaft. Additionally, as the present invention is not limited to the type of material used to form the shaft segments for the athletic equipment or, particularly, the golf shaft illustrated and described herein, other materials that may be particularly suitable for use as golf shaft segments include the aforementioned steel and titanium as well as other metals and metal alloys including aluminum, various metal matrix composites (such as $AlB_4C$ and AlSiC), ceramic matrix composites, as well as other composites such as epoxy bonded graphite, fiberglass, and KEVLAR™.

With continued reference to FIGS. 4 and 5, first shaft segment 112 includes a projection 142 that extends from shoulder 140 to distal end 146. The bond apparatus 136 is disposed between bonding surface 148 and inner surface 128 of second shaft segment 114. The bond apparatus 136 again includes separation elements 152 disposed within an adhesive 154 to axially align and couple the shaft segments. Again, the bond apparatus defines predetermined transverse and axial separation distances 156 and 158, respectively. In order to reduce the weight of the first shaft segment 112, this shaft segment is shown as having an axial passage 160 extending from the distal end 146 of the projection to the butt end of the shaft. The first shaft segment may be manufactured to provide for this passage by wrapping resin impregnated graphite strips about a mandrel in a manner generally known in the art.

The shoulders and projections 40, 140, 46, and 146 of each of the embodiments illustrated in the drawings are preferably machined from the applicable shaft segment. Additionally, the second shaft segment illustrated in the first embodiment shown in FIGS. 2 and 3 may be formed by wrapping resin impregnated materials as described above or by machining a flat piece of stock as is also generally known in the art. Additional materials may be used for either the first or second shaft segments as described above. For example, metal alloys may be swaged from a tubular blank in a manner generally known in the art to form a generally tubular first shaft segment 14 in the embodiment shown in FIGS. 2 or 3 or the tubular second shaft segment 1 20 illustrated in FIGS. 4 and 5. As a general proposition, the tubular shaft segment that defines the inner surfaces 28 and 128 is preferably fabricated of a high strength material such as steel, metal matrix composite, aluminum, titanium, or a ceramic matrix composite whereas the shaft segment having the projection 42 and 142 may be formed of a lighter material having a lesser strength such as the aforementioned epoxy bonded graphite, fiberglass, or KEVLAR™.

Again, the above description of suitable material and methods for manufacturing shaft segments should not be construed as a limitation on the use of the present invention in athletic equipment shafts nor on use of the bond apparatus for bonding the shaft segment. Rather, those skilled in the art will appreciate from this description that a variety of manufacturing methods generally known in the art may be used to form suitable shaft segment configurations from a variety of materials. Moreover, the generally circular or tubular configurations described above may be modified for suitability in other athletic equipment shafts such as hockey sticks, tennis rackets, lacrosse sticks, polo mallets, and the like. One alternative configuration may include rectangular configurations with rounded corners such as are used in hockey sticks.

The invention being thus described, it will obvious that the same may be varied in many ways. Such variations are not to be regarded as a departure from the spirit and scope of the invention, and all such modifications as would be within the knowledge of one skilled in the art are intended to be included within the scope of the following claims.

What is claimed is:

1. An athletic apparatus comprising:

a tubular segment having an inner surface defining a passage;

a shaft segment having a shoulder and a projection extending axially from said shoulder, said projection defining a bonding surface and extending into said passage; and a bond apparatus between said bond surface and said inner surface, said bond apparatus including an adhesive coupling said tubular segment to said shaft segment and a separation element engaging said inner surface and said bonding surface to maintain at least a predetermined distance between said inner surface and said bonding surface, wherein said separation element is a sphere.

2. The athletic apparatus of claim 1, wherein said tubular segment includes a first axis and said shaft segment includes a second axis, said separation element aligning said first axis with said second axis.

3. The athletic apparatus of claim 1, wherein said sphere is a glass bead.

4. The athletic apparatus of claim 3, wherein said glass bead has a diameter of about 5/1000 of an inch.

5. The athletic apparatus of claim 1, wherein said separation element includes a plurality of spheres distributed in said adhesive.

6. The athletic apparatus of claim 1, wherein said tubular segment includes a first end and a second end, said passage extending axially inward from said first end toward said second end, said bond apparatus including a second separation element engaging said first end of said tubular segment and said shoulder to maintain a predetermined separation distance between said first end and said shoulder.

7. The athletic apparatus of claim 1, wherein said tubular segment is formed of a first material and said shaft segment is formed of a second material different from said first material.

8. The athletic apparatus of claim 7, wherein said first material is steel and said second material is graphite.

9. A golf shaft comprising:

a first shaft segment having an inner surface defining a passage;

a second shaft segment having a shoulder and a projection extending axially from said shoulder, said projection defining a bonding surface, said projection extending into said passage; and a bond apparatus between said bond surface and said inner surface, said bond apparatus including an adhesive coupling said first shaft segment to said second shaft segment and a separation element engaging said inner surface and said bonding surface to maintain at least a predetermined distance between said inner surface and said bonding surface, wherein said separation element is a sphere.

10. The golf shaft of claim 9, wherein said first shaft segment includes a first axis and said second shaft segment includes a second axis, said separation element aligning said first axis with said second axis.

11. The golf shaft of claim 9, wherein said sphere is a glass bead.

12. The golf shaft of claim 11, wherein said glass bead has a diameter of about 5/1000of an inch.

13. The golf shaft of claim 9, wherein said separation element includes a plurality of spheres distributed in said adhesive.

14. The golf shaft of claim 13, wherein each of said plurality of spheres are glass beads.

15. The golf shaft of claim 14, wherein said inner surface is cylindrical or conical about an axis of said first shaft segment, said bonding surface is cylindrical or conical about an axis of said second shaft segment, and said glass beads are distributed about said bonding surface to maintain said inner surface a predetermined separation distance from said bonding surface, said predetermined separation distance being uniform about said bonding surface.

16. The golf shaft of claim 13, wherein the ratio of the combined volume of said spheres is within the range of about one percent to about two percent of the volume of adhesive.

17. The golf shaft of claim 16, wherein the ratio of the combined volume of said spheres relative to the volume of adhesive is about one percent.

18. The golf shaft of claim 9, wherein said first shaft segment includes a first end and a second end, said passage extending axially inward from said first end toward said second end, said bond apparatus including a second separation element engaging said first end of said first shaft segment and said shoulder to maintain a predetermined separation distance between said first end and said shoulder.

19. The golf shaft of claim 9, wherein said first shaft segment is formed of steel, titanium, aluminum, a metal matrix composite, or a ceramic matrix composite.

20. The golf shaft of claim 9, wherein said second shaft segment is formed of graphite, fiberglass, or KEVLAR™.

21. The golf shaft of claim 9, wherein said first shaft segment is formed of a metal matrix composite.

22. The golf shaft of claim 9, wherein said first shaft segment is formed of titanium.

23. The golf shaft of claim 9, wherein said first shaft segment is formed of a ceramic matrix composite.

24. The golf shaft of claim 9, wherein said projection extends into said passage to define bond length that is within the range of about one-half inch to about five inches.

25. The golf shaft of claim 9, wherein said projection defines an end face that is located within the range of about one-half to about five inches from said shoulder.

26. A golf club comprising:

a club head;

a grip; and a shaft having a butt end coupled to said grip and a tip end coupled to said club head, said golf shaft further including, a first shaft segment having an inner surface defining a passage, a second shaft segment having a shoulder and a projection extending axially from said shoulder, said projection defining a bonding surface and extending into said passage, and a bond apparatus between said bond surface and said inner surface, said bond apparatus including an adhesive coupling said first shaft segment to said second shaft segment and a separation element engaging said inner surface and said bonding surface to maintain at least a predetermined distance between said inner surface and said bonding surface, wherein said separation element is a sphere.

27. The golf club of claim 26, wherein said first shaft segment includes a first axis and said second shaft segment includes a second axis, said separation element aligning said first axis with said second axis.

28. The golf club of claim 27, wherein said first shaft segment includes a first end and a second end, said passage extending axially inward from said first end toward said second end, said bond apparatus including a second separation element engaging said first end of said first shaft segment and said shoulder to maintain a predetermined separation distance between said first end and said shoulder.

29. The golf club of claim 28, wherein said second end of said first shaft segment defines said butt end of said shaft and wherein said second shaft segment has an end opposite said projection that defines said tip end of said shaft.

30. The golf club of claim 28, wherein said second end of said first shaft segment defines said tip end of said shaft and wherein said second shaft segment has an end opposite said projection that defines said butt end of said shaft.

* * * * *